US010443956B2

(12) United States Patent
Yoshioka et al.

(10) Patent No.: US 10,443,956 B2
(45) Date of Patent: Oct. 15, 2019

(54) HEAT EXCHANGER

(71) Applicant: DAIKIN INDUSTRIES, LTD., Osaka (JP)

(72) Inventors: Shun Yoshioka, Osaka (JP); Yoshiyuki Matsumoto, Osaka (JP); Satoshi Inoue, Osaka (JP); Junichi Hamadate, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/095,230

(22) PCT Filed: Mar. 14, 2017

(86) PCT No.: PCT/JP2017/010162
§ 371 (c)(1),
(2) Date: Oct. 19, 2018

(87) PCT Pub. No.: WO2017/183361
PCT Pub. Date: Oct. 26, 2017

(65) Prior Publication Data

US 2019/0137193 A1 May 9, 2019

(30) Foreign Application Priority Data

Apr. 20, 2016 (JP) ..... 2016-084250

(51) Int. Cl.
*F28F 1/32* (2006.01)
*F25B 39/00* (2006.01)
*F28F 1/02* (2006.01)

(52) U.S. Cl.
CPC ..... *F28F 1/325* (2013.01); *F25B 39/00* (2013.01); *F28F 1/02* (2013.01); *F28F 1/32* (2013.01); *F28F 2215/12* (2013.01)

(58) Field of Classification Search
CPC ..... F28F 1/325; F28F 1/02; F28F 1/32; F28F 2215/12; F25B 39/00
See application file for complete search history.

(56) References Cited

U.S. PATENT DOCUMENTS 2,656,808 A * 10/1953 Plumeri ..... B21C 37/24 165/181
5,582,246 A * 12/1996 Dinh ..... B21D 53/02 165/151

(Continued)

FOREIGN PATENT DOCUMENTS

JP H09-310993 A 12/1997
JP H10-78295 A 3/1998

(Continued)

OTHER PUBLICATIONS

International Search Report issued in corresponding International Application No. PCT/JP2017/010162 dated May 30, 2017, with translation (5 pages).

(Continued)

*Primary Examiner* — Jon T. Schermerhorn, Jr.
(74) *Attorney, Agent, or Firm* — Osha Liang LLP

(57) ABSTRACT

A heat exchanger includes: a plurality of flat tubes that each have a cross-sectional shape perpendicular to a direction of flow of refrigerant with a width direction that extends in an air flow direction; and a plurality of heat transfer fins each having a plurality of notches that receive the plurality of flat tubes. The plurality of notches is disposed along the width direction. The plurality of heat transfer fins includes at least three stands, disposed on a periphery of each of the plurality of notches, that form gaps between adjacent heat transfer fins. The at least three stands are disposed to not face each other across a reference line that extends in the width direction through a perpendicular center of each of the plurality of flat tubes.

2 Claims, 14 Drawing Sheets

(56) References Cited

U.S. PATENT DOCUMENTS

| | | | | |
|---|---|---|---|---|
| 10,082,344 | B2 * | 9/2018 | Tanda | F25B 39/00 |
| 2011/0030932 | A1 * | 2/2011 | Tucker | B21D 53/08 165/151 |
| 2012/0103583 | A1 * | 5/2012 | Kim | F28D 1/05391 165/173 |
| 2013/0284416 | A1 | 10/2013 | Jindou et al. | |
| 2013/0340986 | A1 * | 12/2013 | Lee | F28F 1/32 165/181 |
| 2015/0075213 | A1 * | 3/2015 | Ishibashi | F28F 1/32 62/498 |
| 2018/0106563 | A1 * | 4/2018 | Nakamura | F28D 1/0535 |
| 2018/0306529 | A1 * | 10/2018 | Kasamatsu | F28D 1/0426 |
| 2018/0320989 | A1 * | 11/2018 | Baba | F28D 1/05366 |

FOREIGN PATENT DOCUMENTS

| | | | |
|---|---|---|---|
| JP | 2012-163318 | A | 8/2012 |
| WO | 2016/038652 | A1 | 3/2016 |

OTHER PUBLICATIONS

Written Opinion of the International Searching Authority issued in corresponding International Application No. PCT/JP2017/010162 dated May 30, 2017 (5 pages).

Office Action issued in corresponding Japanese Patent Application No. 2017-045813 dated May 17, 2017, with translation (8 pages).

Notification of Transmittal of Translation of the International Preliminary Report on Patentability for International Application No. PCT/JP2017/010162, dated Nov. 1, 2018 (1 page).

International Preliminary Report on Patentability issued in corresponding International Application No. PCT/JP2017/010162, dated Nov. 1, 2018 (8 pages).

* cited by examiner

HEAT EXCHANGER

TECHNICAL FIELD

The present invention relates to a heat exchanger, more particularly, to a heat exchanger used for exchanging heat between air and refrigerant.

BACKGROUND

There is known a heat exchanger such as the one described in Patent Literature 1 (Japanese Patent Unexamined Publication 2012-163318) that includes a plurality of heat transfer fins arranged parallel to one another and a plurality of flat tubes that are inserted into the heat transfer fins. In Patent Literature 1, the flat tubes are thin and hence notches in the flat tubes are small. Because of this, part of the heat transfer fin is lanced and raised and used as a spacer for securing a gap between adjacent heat transfer fins.

However, as described in Patent Literature 1, air flow resistance increases when the raised-lance element is disposed perpendicular to an air flow direction. Arranging the raised-lance element parallel to the air flow direction in order to avoid an increase in air flow resistance could be conceived, but drainability of condensed water decreases if the raised-lance element is arranged parallel to the air flow direction.

SUMMARY

One or more embodiments of the present invention provide a high-quality heat exchanger in which flat tubes are inserted into notches in heat transfer fins, that can reduce an increase in air flow resistance and a decrease in drainability of condensed water while ensuring fin pitch.

A heat exchanger according to a first example of one or more embodiments of the present invention is a heat exchanger including a plurality of flat tubes that each have a cross-sectional shape perpendicular to a direction of flow of refrigerant with a width direction that extends in an air flow direction; and a plurality of heat transfer fins each having a plurality of notches configured to receive the plurality of flat tubes, the plurality of notches being along the width direction of the plurality of flat tubes, in which the plurality of heat transfer fins includes at least three standing portions provided on a peripheral portion of each of the plurality of notches for forming gaps between adjacent heat transfer fins, and the at least three standing portions are arranged so as not to face each other across a reference line that extends in the width direction through a perpendicular center portion of the flat tube.

In the heat exchanger according to the first example of one or more embodiments of the present invention, because the standing portions are arranged so as not to face each other across the reference line that extends in the width direction through the perpendicular center portion of the flat tube, sufficient standing height of the standing portion can be ensured and fin pitch can be maintained by the standing portions. In addition, by providing at least three standing portions, the positional relationship between adjacent heat transfer fins can be stabilized, and strength of the brazed heat transfer fins can be stably secured.

A heat exchanger according to a second example of one or more embodiments of the present invention is the heat exchanger according to the first example of one or more embodiments, in which each of the plurality of heat transfer fins includes, in the notch, a plurality of the standing portions on each of two long sides that face each other across the reference line.

In the heat exchanger according to the second example of one or more embodiments of the present invention, a plurality of standing portions is provided on each long side of the notch, and hence stability can be improved when the plurality of heat transfer fins are stacked.

A heat exchanger according to a third example of one or more embodiments of the present invention is the heat exchanger according to the second example of one or more embodiments of the present invention, in which, in each of the plurality of heat transfer fins, the standing portions on the two long sides of the notches are alternately arranged along the reference line.

In the heat exchanger according to the third example of one or more embodiments of the present invention, because the standing portions on the two long sides are alternately arranged along the reference line, the standing portions can be made taller and a range compatible with a thickness direction of the flat tube perpendicular to the width direction of the flat tube can be expanded to include a thin flat tube.

A heat exchanger according to a fourth example of one or more embodiments of the present invention is the heat exchanger according to the third example of one or more embodiments, in which, in each of the plurality of heat transfer fins, the standing portions on the two long sides of the notch each form a wave-shape such that the standing portions can be fitted into one another when pushed down into the notch.

In the heat exchanger according to the fourth example of one or more embodiments of the present invention, because the standing portions on the two long sides each form a wave-shape such that the standing portions can be fitted into one another when pushed down into the notch, the height of the wave-shaped standing portions until the crest portions can be increased, and the member notched with the notch can be utilized to the fullest extent.

A heat exchanger according to a fifth example of one or more embodiments of the present invention is the heat exchanger according to the second example of one or more embodiments, in which, in each of the plurality of heat transfer fins, each of the plurality of standing portions on each of the long sides forms a wave-shape.

In the heat exchanger according to the fifth example of one or more embodiments of the present invention, because the standing portions form the wave-shape, the crest portions of the wave-shaped standing portions on one long side can be made to correspond to the trough portions of the wave-shaped standing portions on the other long side, and hence a plurality of standing portions can easily be made taller.

A heat exchanger according to a sixth example of one or more embodiments of the present invention is the heat exchanger according to the fifth example of one or more embodiments, in which, in each of the plurality of heat transfer fins, a distance from a wave crest of one of the standing portions in the wave-shaped standing portions on an end of at least one of the two long sides to a wave crest of one of the standing portions in the wave-shaped standing portions on an other end of the at least one of the two long sides is at least one third of a width of the flat tube.

In the heat exchanger according to the sixth example of one or more embodiments of the present invention, because the distance from the wave crest of one of the standing portions in the wave-shaped standing portions on an end of at least one of the two long sides to a wave crest of one of the standing portions in the wave-shaped standing portions on an other end of the at least one of the two long sides is at least one third of a width of the flat tube, the distance that abuts against adjacent heat transfer fins on the long side can be extended to at least one third of the width of the flat tube.

A heat exchanger according to a seventh example of one or more embodiments of the present invention is the heat exchanger according to any one of the first to sixth examples of one or more embodiments, in which, in each of the plurality of heat transfer fins, at least one of the standing portions is arranged at a deepest portion of the notch.

In the heat exchanger according to the seventh example of one or more embodiments of the present invention, because at least one standing portion is arranged at the deepest portion of the notch, the range in which the standing portions are arranged in a direction along the reference line of the notch can be made longer. In addition, the standing portion arranged at the deepest portion has a function of restricting the flat tube when the flat tube is inserted.

A heat exchanger according to an eighth example of one or more embodiments of the present invention is the heat exchanger according to any one of the second to seventh examples of one or more embodiments, wherein, in each of the plurality of heat transfer fins, when viewed from an air flow direction, a height at which intervals between the standing portions disposed on one of the long sides of the notch and the standing portions disposed on the other of the long sides of the notch is at a minimum is less than half of a height of the standing portion.

In the heat exchanger according to the eighth example of one or more embodiments of the present invention, when viewed from the air flow direction, because the height at which the intervals between the standing portions is at a minimum is smaller than half the height of the standing portion, the heat transfer fin and the flat tube sufficiently make contact near a main surface on which the standing portions of the heat transfer fin stand up. By shortening the distance between this point of contact and the main surface of the heat transfer fin, good heat conductivity is achieved between the heat transfer fin and the flat tube. In addition, the flat tube can be unlikely to catch on the notch in the heat transfer fin when the flat tube is inserted into the notch, and the shape distortion of the heat exchanger due to the catching can be reduced.

A heat exchanger according to a ninth example of one or more embodiments of the present invention is the heat exchanger according to any one of the first to eighth examples of one or more embodiments, in which, each of the plurality of heat transfer fins includes a protruding portion that is provided between adjacent notches and protrudes in a direction opposite to the standing portion, and a flat portion provided between the protruding portion and the notch, and in which the standing portion of one of adjacent heat transfer fins is provided so as to abut against the flat portion of another of the adjacent heat transfer fins.

In the heat exchanger according to the ninth example of one or more embodiments of the present invention, one standing portion in adjacent heat transfer fins is provided so as to abut against another flat portion, and hence the standing portion can easily move to the flat portion without stopping at the protruding portion when the plurality of heat transfer fins are stacked, and hence stacking time can be easily shortened and manufacturing costs can be reduced.

A heat exchanger according to a tenth example of one or more embodiments of the present invention is the heat exchanger according to any one of the first to ninth examples of one or more embodiments, in which each of the plurality of heat transfer fins has a reflare portion in which each of the standing portions is bent into an curved shape on a side opposite to the notch, and in which a position of the reflare portion at which the height of the standing portion is at a maximum is located outward of an edge of the notch by a predetermined distance.

In the heat exchanger according to the tenth example of one or more embodiments of the present invention, because the position of the reflare portion at which the height of the standing portion is at a maximum is located outward of the edge of the notch by a predetermined distance, an error in the fin pitch caused by deformation around the notch can be reduced.

With the heat exchanger according to the first example of one or more embodiments of the present invention, there is no need to provide extra raised-lance elements for a gap between adjacent fins in, for example, an air flow passage, and hence an increase in air flow resistance and a decrease in drainability of condensed water can be reduced and there can be provided a high-quality heat exchanger having stable fin pitch and mounting strength of the heat transfer fins.

With the heat exchanger according to the second example of one or more embodiments of the present invention, high dimensional accuracy can be obtained in terms of the positional relationship between the plurality of heat transfer fins.

With the heat exchanger according to the third or fifth examples of one or more embodiments of the present invention, it is easier to employ a thin flat tube and the thin flat tube has a larger applicable range.

With the heat exchanger according to the fourth example of one or more embodiments of the present invention, it is easier to obtain high dimensional accuracy and mounting strength in terms of the positional relationship between the plurality of heat transfer fins even when a thin flat tube is employed.

With the heat exchanger according to the sixth example of one or more embodiments of the present invention, the heat transfer fins can be more easily stabilized when the plurality of heat transfer fins are stacked and it is easier to provide a heat exchanger that has even intervals between heat transfer fins.

With the heat exchanger according to the seventh example of one or more embodiments of the present invention, dimensional accuracy between the stacked heat transfer fins and dimensional accuracy and mounting strength between the heat transfer fins and the flat tubes can be increased.

With the heat exchanger according to the eighth example of one or more embodiments of the present invention, good heat conductivity between the heat transfer fin and the flat tube can be stably secured and high product quality can be maintained.

With the heat exchanger according to the ninth example of one or more embodiments of the present invention, costs can be reduced and the heat exchanger can be provided at low cost.

With the heat exchanger according to the tenth example of one or more embodiments of the present invention, dimensional accuracy of the stacked heat transfer fins can be improved.

DETAILED DESCRIPTION

A heat exchanger according to one or more embodiments of the present invention is described with reference to FIGS. 1 to 9.

(1) HEAT EXCHANGER

Figure 1:
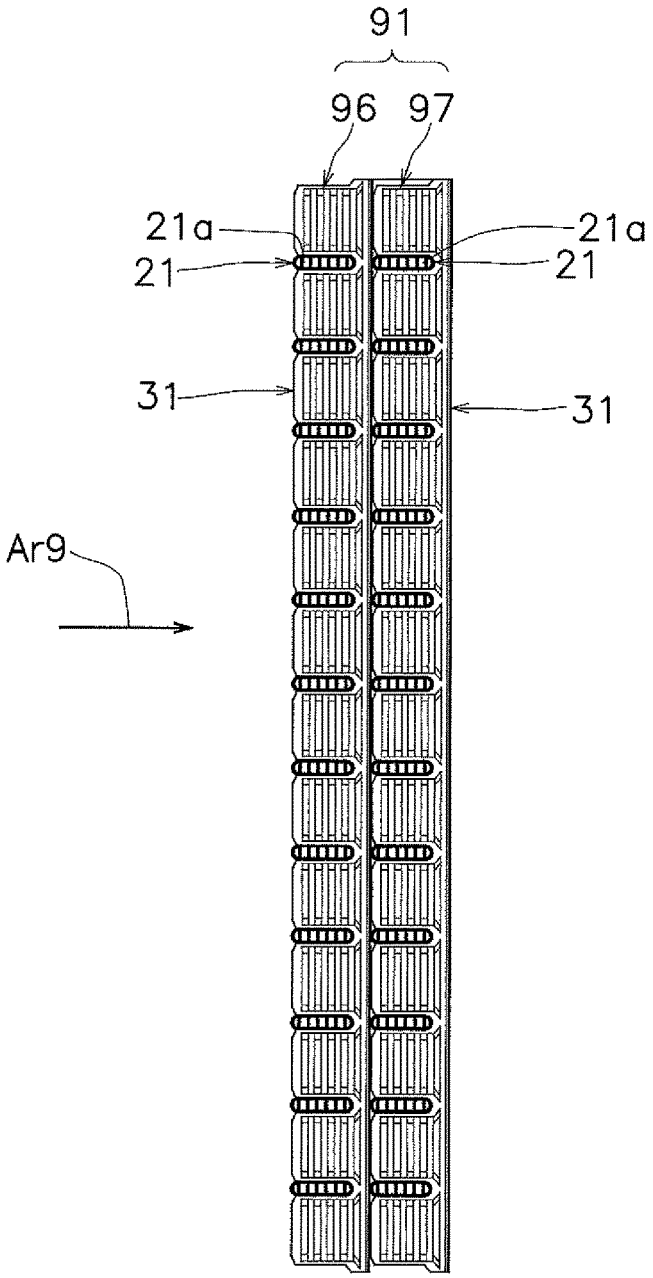
FIG. 1 is a cross-sectional view for illustrating the structure of a heat exchanger and its vicinity according to a first embodiment of embodiments of the present invention.

As illustrated in FIG. 1, a heat exchanger 91 according to one or more embodiments includes a first heat exchange portion 96 and a second heat exchange portion 97. The first heat exchange portion 96 is disposed on a windward side and the second heat exchange portion 97 is disposed on a leeward side. Both the first heat exchange portion 96 and the second heat exchange portion 97 include a plurality of flat tubes 21 arranged in rows and a plurality of heat transfer fins 31 that intersect with the plurality of flat tubes 21. The flat tubes 21 and the heat transfer fins 31 are substantially orthogonal to each other. Only one heat transfer fin 31 of each of the first heat exchange portion 96 and the second heat exchange portion 97 is illustrated in FIG. 1. Other heat transfer fins 31 that are adjacent to the heat transfer fins 31 illustrated in FIG. 1 are arranged parallel to the heat transfer fins 31 in FIG. 1.

(1-1) Configuration of Flat Tube 21

As illustrated in FIG. 1, a plurality of flow passages 21*a* are formed as one windward-to-leeward row inside one flat tube 21, and the refrigerant flows through each of these flow passages 21*a*. In other words, the width direction of the cross-sectional shape of the flat tube 21 perpendicular to the direction of flow of refrigerant in each flow passage 21*a* extends in an air flow direction (direction of the arrow Ar9).

(1-2) Configuration of Heat Transfer Fin 31

Figure 2:
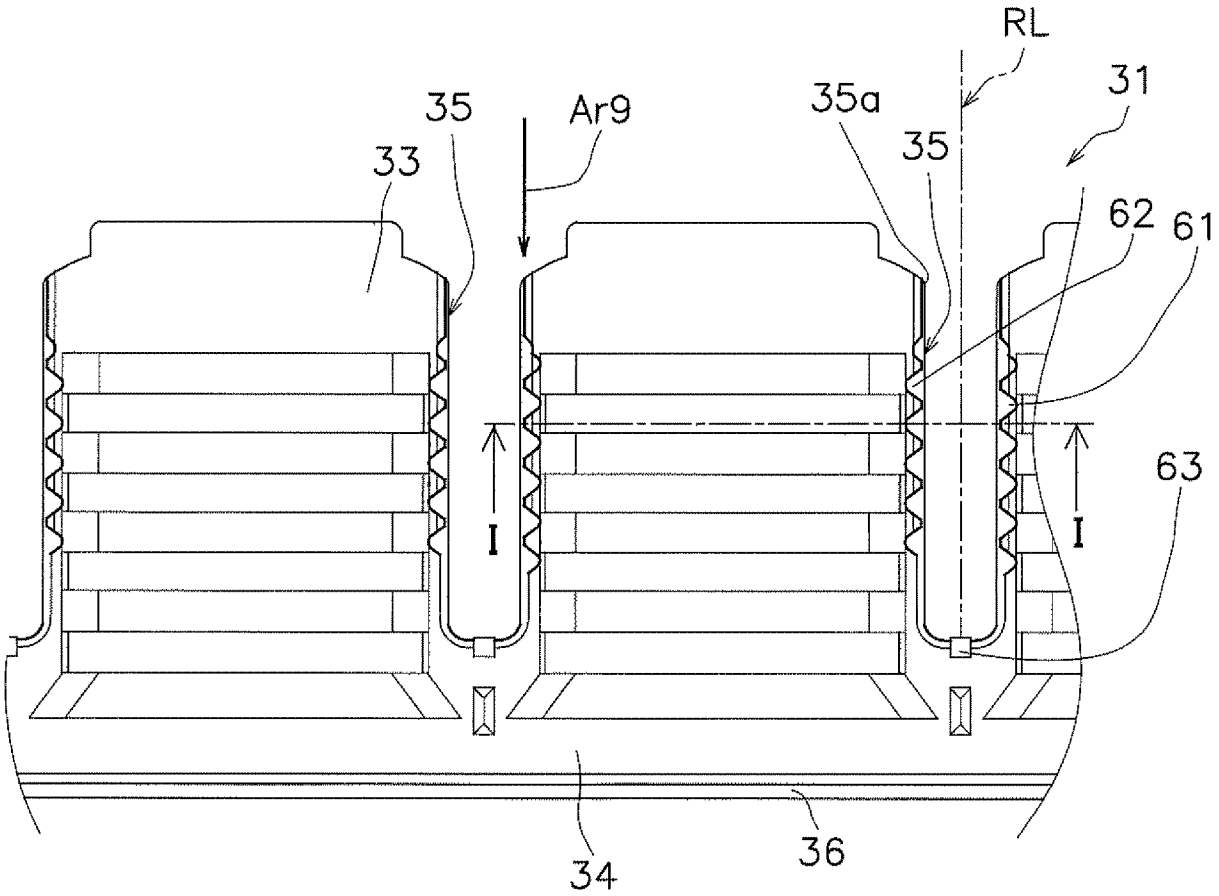
FIG. 2 is a partially expanded plan view of a part of a heat transfer fin according to one or more embodiments.

In FIG. 2, a part of the heat transfer fin 31 according to one or more embodiments is illustrated in a further expanded manner. The heat transfer fin 31 includes a windward main portion 33 formed with a notch 35 that receives the flat tube 21, and a leeward communication portion 34 located on a side opposite to an open end 35*a* of the notch 35. In the heat transfer fin 31, a plurality of the notches 35 that receive the plurality of flat tubes 21 are formed along the width direction of the flat tube 21. In other words, the notches 35 extend in the air flow direction (direction of the arrow Ar9). The flat tube 21 is inserted in the direction of the arrow Ar9 in FIG. 2. A guide rib 36 that facilitates condensed water discharge is formed in the communication portion 34. This guide rib 36 is a portion that extends from a pressed groove. A protruded structure extends in the up-down direction along the guide rib 36 when the guide rib 36 is viewed from a one main surface f1 of the heat transfer fin 31, while a recessed structure extends in the up-down direction along the guide rib 36 when the guide rib 36 is viewed from an other main surface on a side opposite to the one main surface f1.

Figure 3:
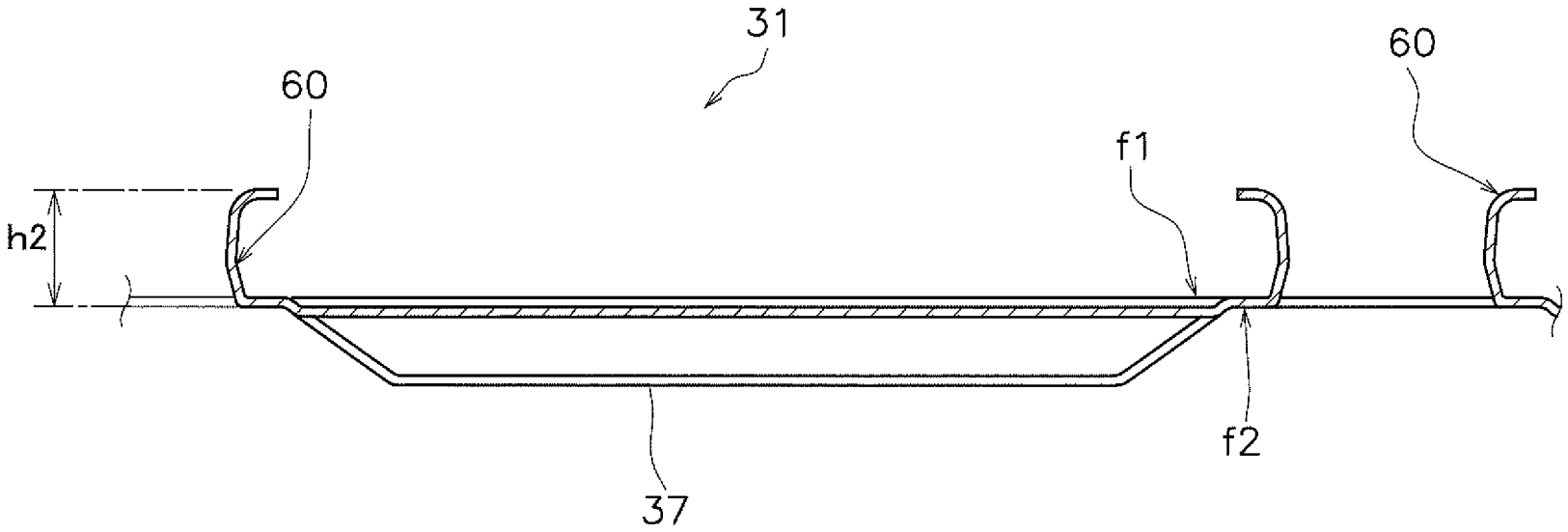
FIG. 3 is a cross-sectional view for illustrating the heat transfer fin taken along the line I-I in FIG. 2.
Figure 4:
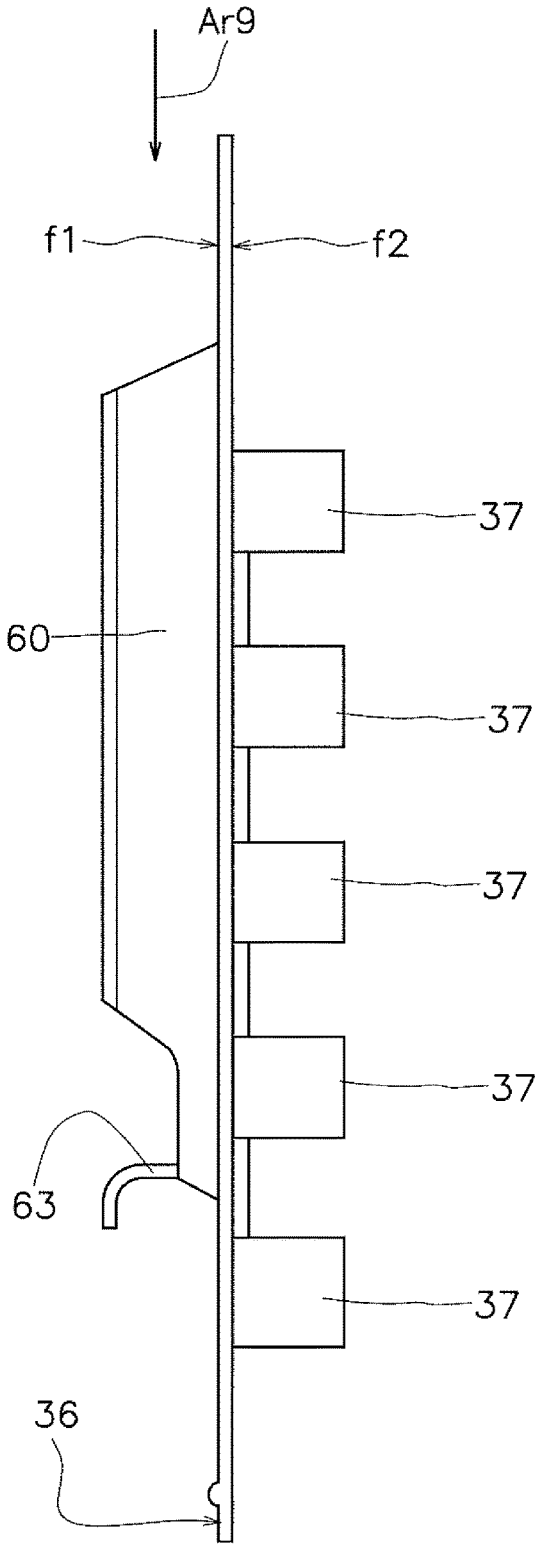
FIG. 4 is a side view for illustrating the heat transfer fin according to one or more embodiments.

FIG. 3 illustrates a cross section taken along the line I-I in FIG. 2. In addition, FIG. 4 illustrates a state of the heat transfer fin 31 illustrated in FIG. 2 when viewed from a direction perpendicular to the air flow direction (direction of the arrow Ar9). As illustrated in FIGS. 3 and 4, collar portions 60 are formed on the side of the one main surface f1 of the first heat transfer fin 31. A plurality of raised-lance elements 37 that protrude in a bridge shape are formed on the side of an other main surface f2 of the heat transfer fin 31. The collar portion 60 has a U-shape so as to surround the notch 35 when the heat transfer fin 31 is viewed in plan (when viewed along the direction in which the flat tube 21 extends). A flat tube 21 that is inserted into the notch 35 is fixed to the collar portion 60 by brazing.

(2) CONFIGURATION OF COLLAR PORTION 60

Figure 5:
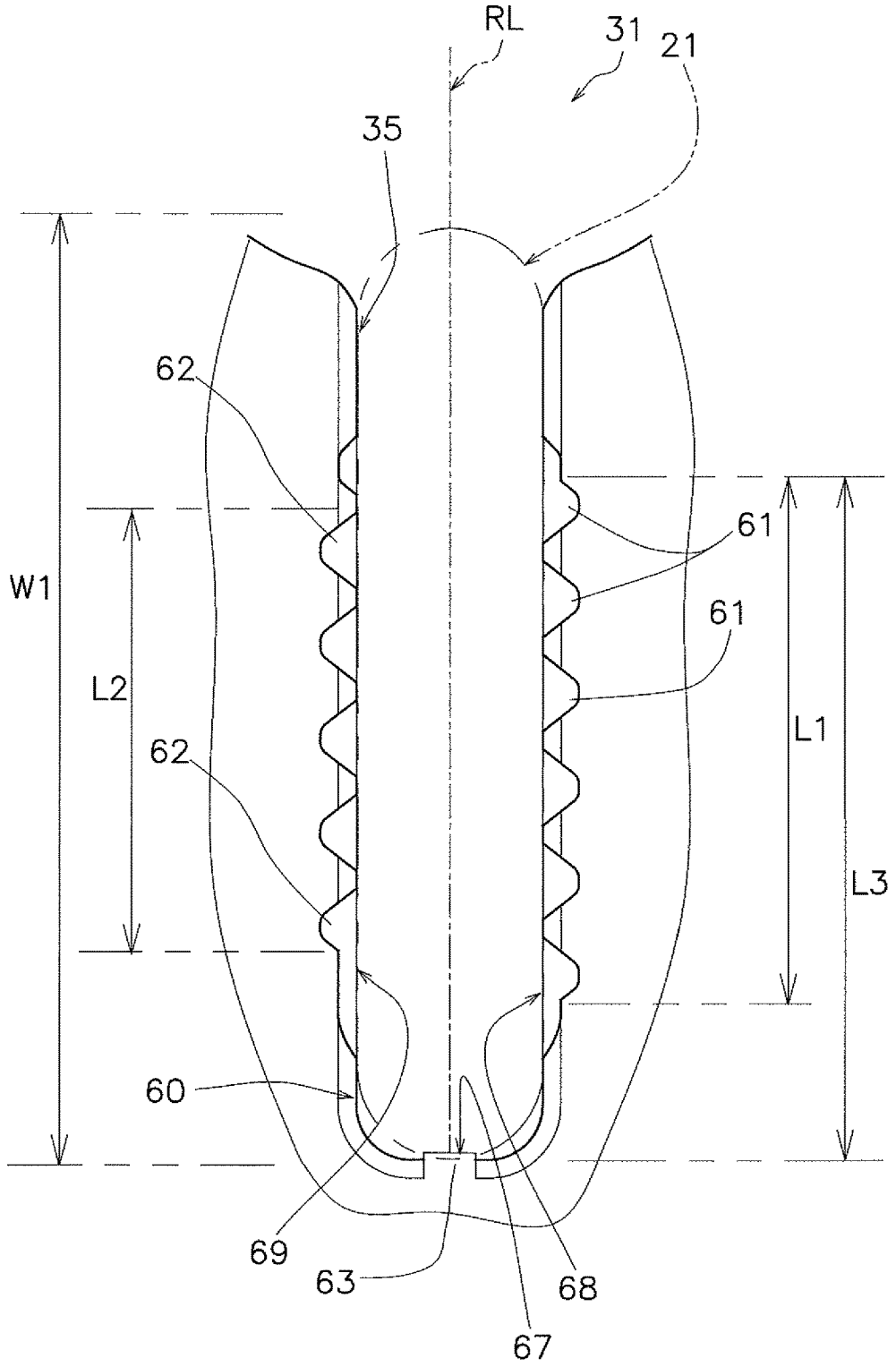
FIG. 5 is a partially expanded plan view for illustrating the heat transfer fin in which an area around a notch of the heat transfer fin is expanded according to one or more embodiments.

In accordance with one or more embodiments, FIG. 5 illustrates an area around the collar portion 60 illustrated in FIG. 2 in an enlarged manner. Each of the plurality of heat transfer fins 31 includes, in the collar portion 60, three types of standing portions (stands) 61, 62, 63 provided on a peripheral portion (periphery) of each notch 35 for forming a gap with an adjacent heat transfer fin 31. In this embodiment, the collar portion 60 includes six wave-shaped standing portions 61, five wave-shaped standing portions 62 and one standing portion 63. Therefore, the number of standing portions 61, 62, 63 included in the collar portion 60 is 12. At least three standing portions 61, 62, 63 are provided so that the standing portions 61, 62, 63 do not face each other across a reference line RL that extends in the width direction through the perpendicular center portion (perpendicular center) of the flat tube 21. In this embodiment, the 12 standing portions 61, 62, 63 are arranged so as not to face each other.

In addition, in the plurality of heat transfer fins 31, a plurality standing portions 61 and a plurality of standing portions 62 are provided on each of two long sides 68, 69 of the notch 35. The two long sides 68, 69 face each other across the reference line RL. More specifically, six standing portions 61 are disposed on the long side 68 and five standing portions 62 are disposed on the long side 69. The six standing portions 61 and the five standing portions 62 are alternately arranged along the reference line RL. The long sides 68, 69 are linear portions along flat surfaces formed in the flat tube 21. A length L1 of the portion in which the standing portions 61 are formed and a length L2 of the portion in which the standing portions 62 are formed are both larger than half a width W1 of the flat tube 21. In addition, at least one standing portion 63 is arranged at a deepest portion 67 of the notch 35 in each of the plurality of heat transfer fins 31. In this embodiment, only one standing portion 63 is provided, but a plurality of standing portions 63 may be provided through, for example, forming the standing portion 63 as a forked shape. The standing portion 63 has a function of restricting the flat tube 21 when the flat tube 21 is inserted. In other words, the flat tube 21 is pushed into the notch 35 until the flat tube 21 abuts against the standing portion 63.

Figure 6:
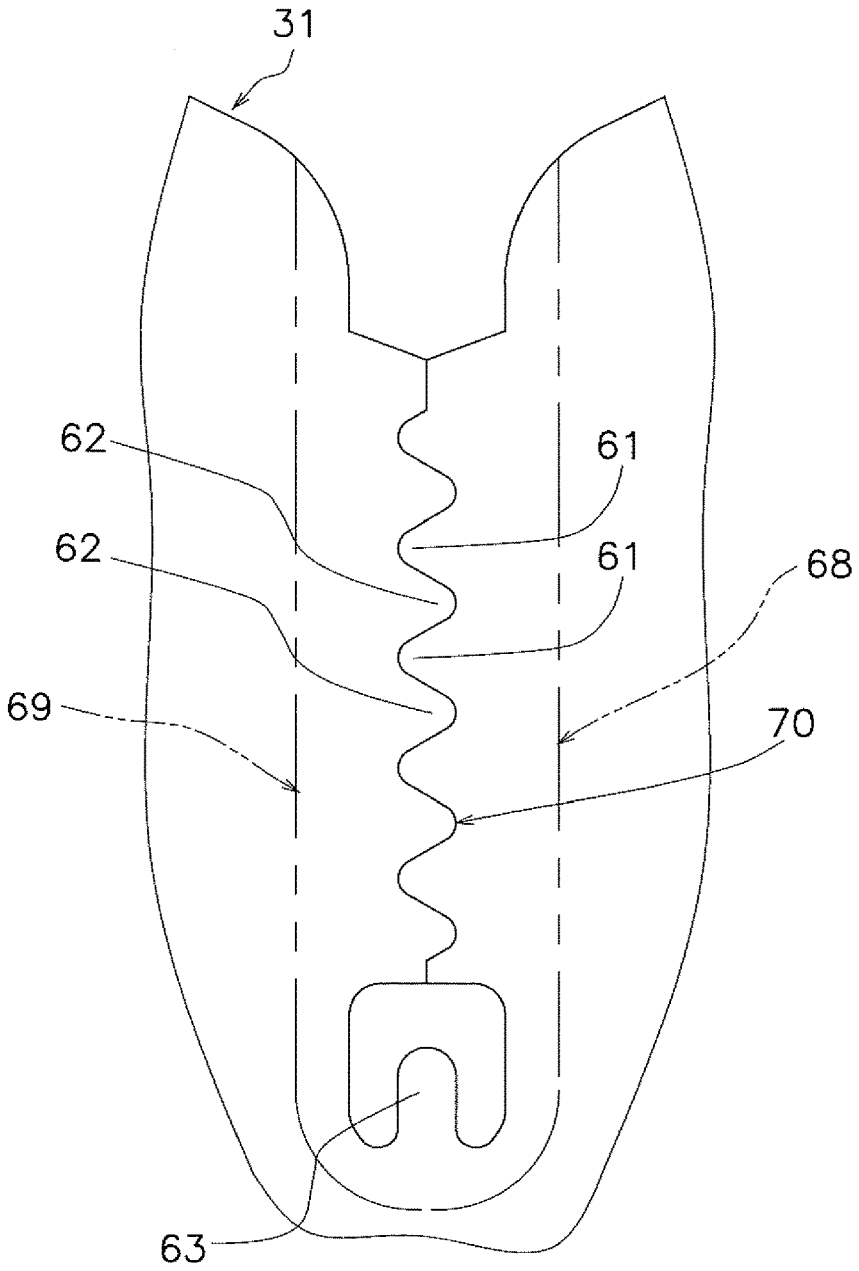
FIG. 6 is a partially expanded plan view of the material of the heat transfer fin for explaining a method for forming a standing portion according to one or more embodiments.

As illustrated in FIG. 6, the standing portions 61, 62 according to one or more embodiments have wave-like shapes so that the standing portions 61, 62 on the two long sides 68, 69 of the notch 35 can be fitted into each other when they are pushed down into the notch 35. In order to form the standing portions 61, 62 into the wave-like shape, a cutting line 70 of the wave-like shape may be formed in a metal plate as the material of the heat transfer fin 31 through, for example, press molding.

Figure 7:
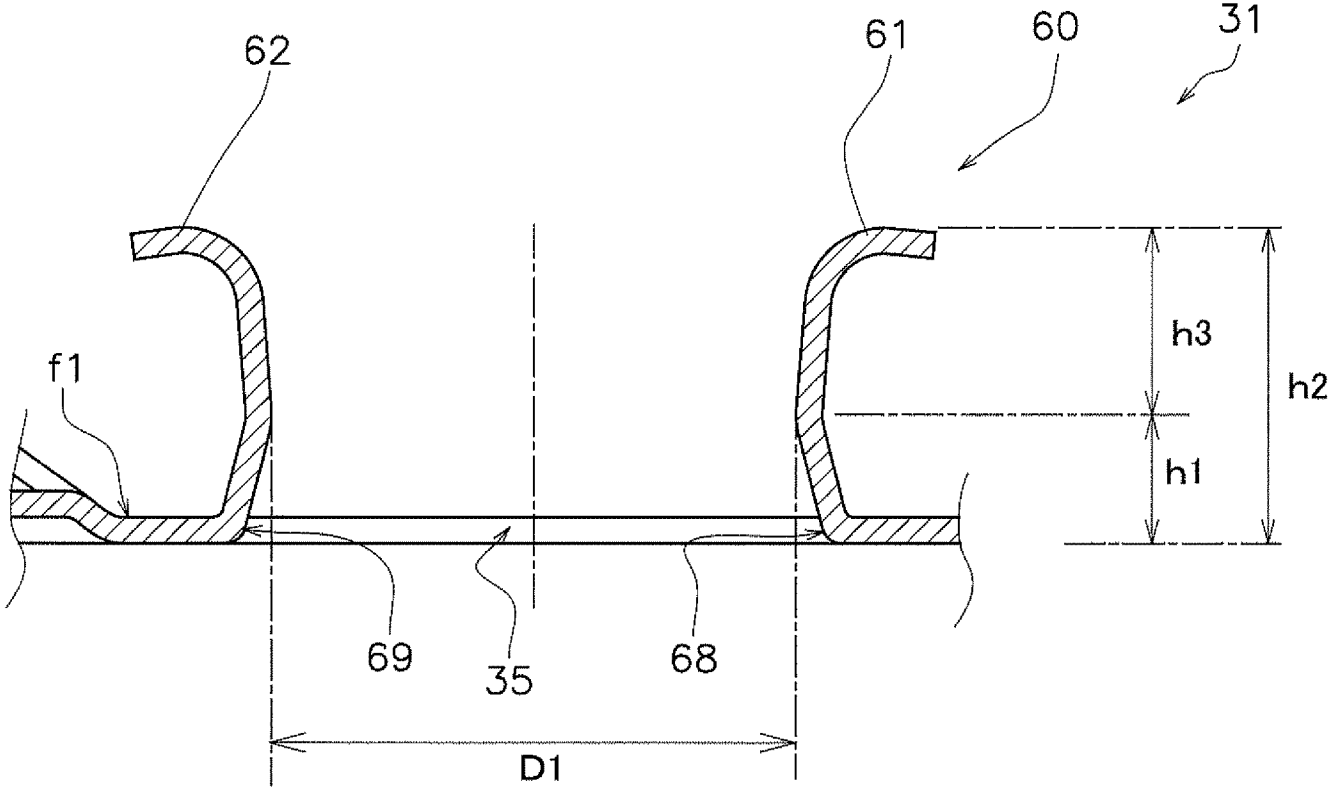
FIG. 7 is a partially expanded cross-sectional view of an area around the standing portion according to one or more embodiments.

As illustrated in FIG. 7, the heat transfer fin 31 according to one or more embodiments is configured such that, when viewed from the wind direction, a height h1 at which the interval between the standing portion 61 disposed on the one long side 68 of the notch 35 and the standing portion 62 disposed on the other long side 69 is a minimum value D1 (i.e., a height that corresponds to a minimum distance) is less than half a height h2 of the standing portions 61, 62. In other words, a height h3 that is a height from a crest portion 61*a*, 61*b* of the standing portion 61, 62 to the position at which the interval becomes the minimum value D1 is smaller than the height h1 at which the interval is the minimum value D1 (h1<h3). This means that the portion at which the interval is the minimum value D1 is formed closer to the one main surface f1 of the heat transfer fin 31.

Figure 8:
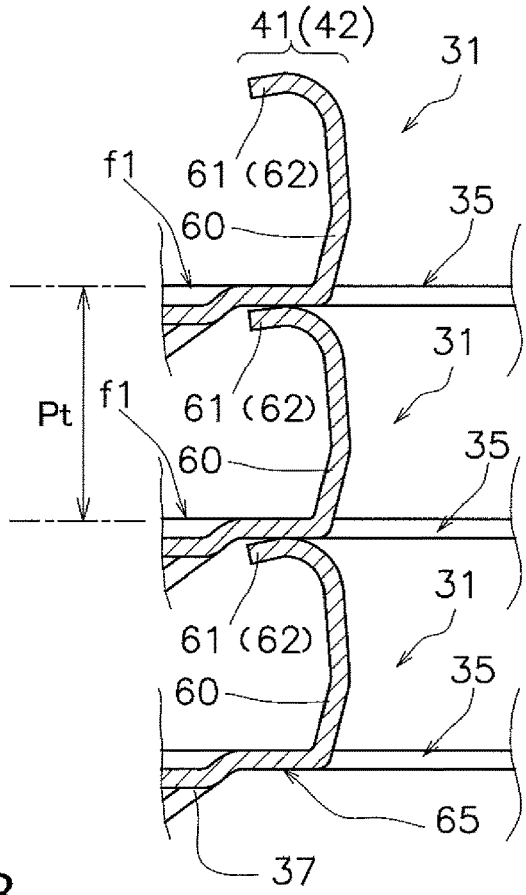
FIG. 8 is a partially expanded cross-sectional view for illustrating a state in which a plurality of heat transfer fins are stacked according to one or more embodiments.

In accordance with one or more embodiments, FIG. 8 illustrates three heat transfer fins 31 of a plurality of stacked heat transfer fins 31. The gap between adjacent heat transfer fins 31 is formed by the collar portion 60. In other words, adjacent heat transfer fins 31 have a predetermined fin pitch Pt. This fin pitch Pt is equal to an interval between adjacent one main surfaces f1.

Figure 9:
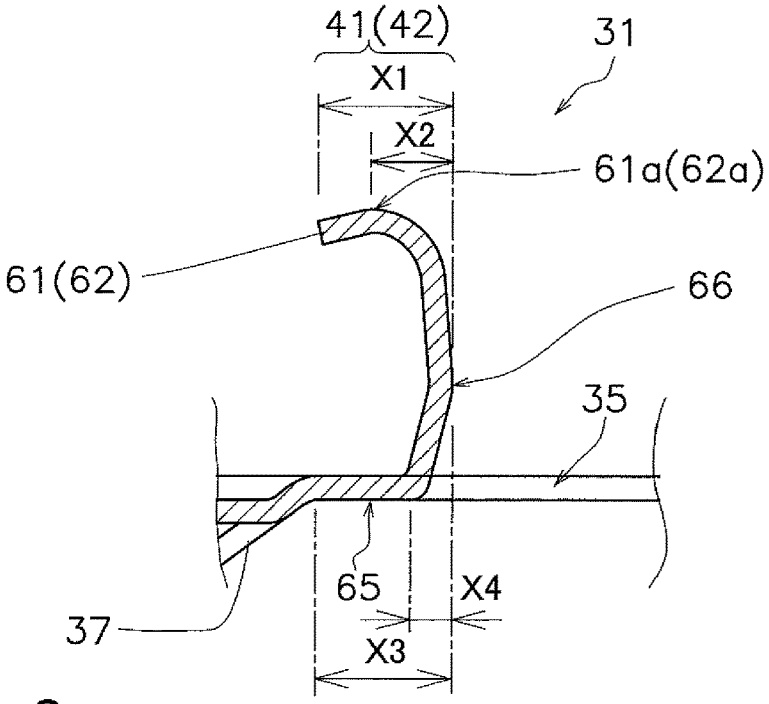
FIG. 9 is a partially expanded cross-sectional view for explaining the shape of the standing portion according to one or more embodiments.

Each of the plurality of stacked heat transfer fins 31 illustrated in FIG. 8 includes a base 65 that is a flat portion. The standing portions 61, 62 of the collar portions 60 in one heat transfer fin 31 abut against the base 65 of an adjacent heat transfer fin 31. Each of the plurality of heat transfer fins 31 has the raised-lance element 37 as a protruding portion (protrusion) that is formed between adjacent notches 35 and that protrudes in a direction opposite to the standing portions 61, 62. The protruding portion is not limited to the raised-lance element 37 and may be any portion that has been, for example, punched out. The base 65 of each heat transfer fin 31 is formed between the raised-lance element 37 and the notch 35. Because the heat transfer fins 31 are provided with the bases 65, the standing portions 61, 62 automatically slide down from the raised-lance elements 37 as the protruding portions and gather at the bases 65 when a large number of three or more heat transfer fins 31 are stacked upon assembling the heat exchanger 91. Because the standing portions 61, 62 can easily move toward the bases 65 without stopping at the raised-lance elements 37 when the plurality of heat transfer fins 31 is stacked, stacking work takes less time and manufacturing labor and time can be reduced, which results in lower manufacturing costs. As illustrated in FIG. 9, a distance X1 from an edge 66 of the notch 35 to an end portion of the standing portion 61, 62 is set smaller than a distance X3 from the edge 66 of the notch 35 to the raised-lance element 37 so that the base 65 and the standing portion 61, 62 can easily abut against each other.

As illustrated in FIG. 9, each heat transfer fin 31 according to one or more embodiments has a reflare portion 41 in which the standing portion 61 is bent into an curved shape on a side opposite to the notch 35 and a reflare portion 42 in which the standing portion 62 is bent into an curved shape on a side opposite to the notch 35. The crest portions 61*a*, 62*a* of the reflare portions 41, 42 where the standing height of the standing portions 61, 62 is at a maximum are located outward than the edge 66 of the notch 35 by a predetermined distance X2. The distance X2 is set such that the flat base 65 is larger than a distance X4 from the edge 66 of the notch 35. In one or more embodiments, consideration of evenly maintaining the fin pitch Pt using the height of the standing portion 61, 62, the distance X2 is set at least 0.2 mm larger than the distance X4 (X2−X4≥0.2 mm).

(3) MODIFICATION EXAMPLES

(3-1) Modification Example 1A

In the collar portion 60 according to one or more embodiments of the present invention, the standing portion 63 is arranged at the deepest portion of the notch 35, but the standing portion 63 may be omitted.

(3-2) Modification Example 1B

In the above-described embodiments, the standing portions 61, 62 formed into the wave-shape depict a wavy line that looks like a sine wave, but the wave shape formed by the standing portions 61, 62 does not need to be a wavy line and also includes, for example, a shape in which a triangle shape or a square shape repeats.

(3-3) Modification Example 1C

In the above-described embodiments, the heat transfer fin 31 communicates on the leeward side (see FIG. 1), but the heat transfer fin may communicate on the windward side.

(3-4) Modification Example 1D

The heat exchanger according to one or more embodiments of the present invention can be applied to an indoor unit of an air conditioner, an outdoor unit of an air conditioner, or a heat exchanger for a vehicle.

(4) FEATURES 4-1

As described with reference to FIGS. 2 to 5, the standing portions 61, 62, 63 in the collar portions 60 of each of the plurality of heat transfer fins 31 are arranged so as not to face each other across the reference line RL that extends in the width direction through the perpendicular center portion of the flat tube 21. Because of this, sufficient standing height of the standing portions 61, 62, 63 can be ensured and the fin pitch Pt (see FIG. 8) can be maintained with the standing portions 61, 62, 63. In addition, through providing three or more of the standing portions 61, 62, 63, the positional relationship between adjacent heat transfer fins 31 can be stabilized, and strength of the brazed heat transfer fins 31 can be stably maintained. As a result, unlike with a conventional heat exchanger, there is no need to provide extra raised-lance elements for forming gaps between adjacent fins in an air flow passage or the like. As a result, an increase in air flow resistance and a decrease in drainability of condensed water can be reduced, and there can be provided a high-quality heat exchanger with stable fin pitch Pt and heat transfer fin 31 mounting strength. The three or more standing portions may be combined such that there are, for example, two standing portions 61 and one standing portion 62, or one standing portion 61 and two standing portions 62.

4-2

In the above-described embodiments, a plurality of standing portions 61, 62 are provided on each long side 68, 69 of the notch 35, and hence stability is improved when the plurality of heat transfer fins 31 are stacked. Improving stability means that the positional relationship between adjacent heat transfer fins 31 is accurately determined. Therefore, high dimensional accuracy can be afforded to the positional relationship between the plurality of heat transfer fins 31.

4-3

As described with reference to FIGS. 5 and 6, because the standing portions 61, 62 on the two long sides 68, 69 are alternately arranged along the reference line RL, the standing portions 61, 62 can be made taller. Because the standing portions 61, 62 are formed by raising a piece of metal at a portion of the notch 35, the height thereof is naturally restricted by the size of the piece of metal at the portion of the notch 35. However, because the standing portions 61, 62 are alternately arranged along the reference line RL, the distance from the crest portions 61*a*, 61*b* of the standing portions 61, 62 to the long sides 68, 69 when taken along the section illustrated in FIG. 6 is longer compared to a case where the standing portions are formed separately across the reference line RL. Therefore, the length from the crest portions 61*a*, 61*b* of the standing portions 61, 62 to the long sides 68, 69 can be easily secured even if the flat tube 21 is thin in the direction perpendicular to the width direction. As a result, the length from the crest portions 61*a*, 61*b* of the standing portions 61, 62 to the long sides 68, 69 can be secured even if the flat tube 21 is thin, and even a thin flat tube in the thickness direction is within the applicable range of the flat tube 21.

4-4

Because the standing portions 61, 62 on the two long sides 68, 69 form wave-shapes that can be fitted into each other when pushed down into the notch 35, the crest portions 61*a*, 61*b* of the wave-shaped standing portions 61, 62 can be made taller, and the member notched with the notch 35 can be utilized to the fullest extent. Even when a thin flat tube 21 is used, high dimensional accuracy and mounting strength can easily be obtained in terms of the positional relationship between the plurality of heat transfer fins 31.

4-5

As illustrated in FIG. 5, because at least one standing portion 63 is arranged at the deepest portion 67 of the notch 35, the range in which the standing portions 61, 62, 63 are arranged in the direction of the reference line RL in the notch 35 can be made longer. In other words, the length of a standing portion arrangement area when the standing portion 63 is not provided is the length L1 or L2, but the length of the standing portion arrangement area when the standing portion 63 is provided can be extended up until the length L3. The standing portion 63 arranged at the deepest portion 67 also has a function of restricting the flat tube when the flat tube is inserted. As a result, dimensional accuracy between the stacked heat transfer fins 31, and dimensional accuracy and mounting strength between the heat transfer fins 31 and the flat tubes 21 can be improved.

4-6

As described with reference to FIG. 7, because the height h1 at which the interval between the standing portions 61, 62 is the minimum value D1 is less than half the height h2 of the standing portion 61, 62 when viewed from the air flow direction, the heat transfer fins 31 and the flat tubes 21 make sufficient contact near the main surfaces f1 at which the standing portions 61, 62 of the heat transfer fins 31 stand up. In addition, the flat tube 21 can be prevented from catching on the notch 35 in the heat transfer fin 31 when the flat tube 21 is inserted into the notch 35, and the shape of the heat exchanger 91 can be prevented from distorting due to catching. Further, good heat conductivity between the heat transfer fins 31 and the flat tubes 21 can be achieved by shortening the distance between the main surfaces f1 of the heat transfer fins 31 and the flat tubes 21. As a result, dimensional accuracy between the stacked heat transfer fins 31, and dimensional accuracy and mounting strength between the heat transfer fins 31 and the flat tubes 21 can be improved.

4-7

As described with reference to FIG. 8, because the standing portion 61, 62 on one of the adjacent heat transfer fins 31 is formed so as to abut against the base 65 (example of flat portion) of the other adjacent heat transfer fin 31, the standing portion 61, 62 can easily move to the base 65 without stopping at the raised-lance element 37 (example of protruding portion) when the plurality of heat transfer fins 31 is stacked, and hence stacking time can be shortened and manufacturing costs can be reduced. Due to reducing manufacturing costs, the heat exchanger 91 can be provided at low cost.

4-8

As described with reference to FIG. 9, because the positions of the crest portions 61*a*, 62*a* of the reflare portions 41, 42 at which the standing portions 61, 62 have a maximum height are located outward of the edge 66 of the notch 35 by the predetermined distance X2 (≥X4), an error in the fin pitch Pt (see FIG. 8) caused by deformation around the notch 35 can be prevented. With this configuration, dimensional accuracy of the stacked heat transfer fins can be improved.

A heat exchanger according to one or more embodiments of the present invention is described with reference to FIGS. 10 to 17.

(5) HEAT EXCHANGER

Figure 10C:
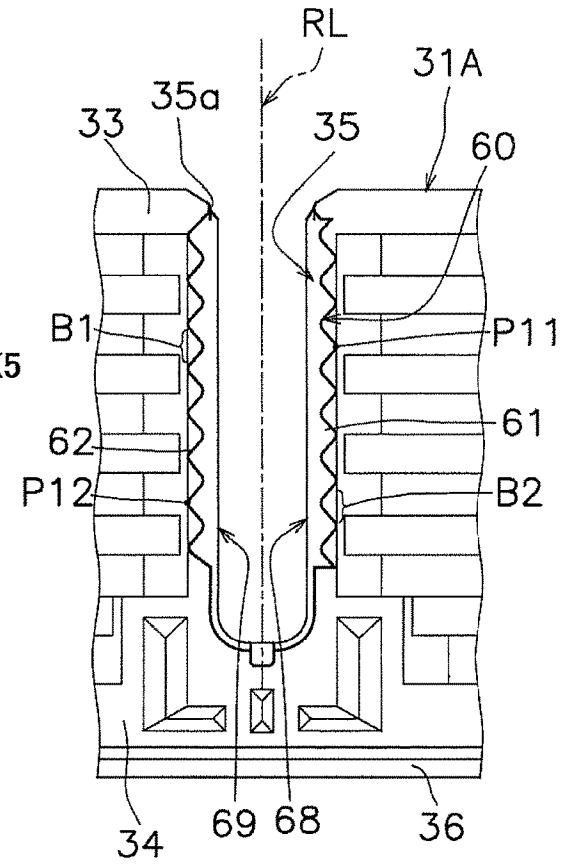
FIG. 10C is a partially expanded plan view of part of the heat transfer fin according to one or more embodiments.
Figure 10B:
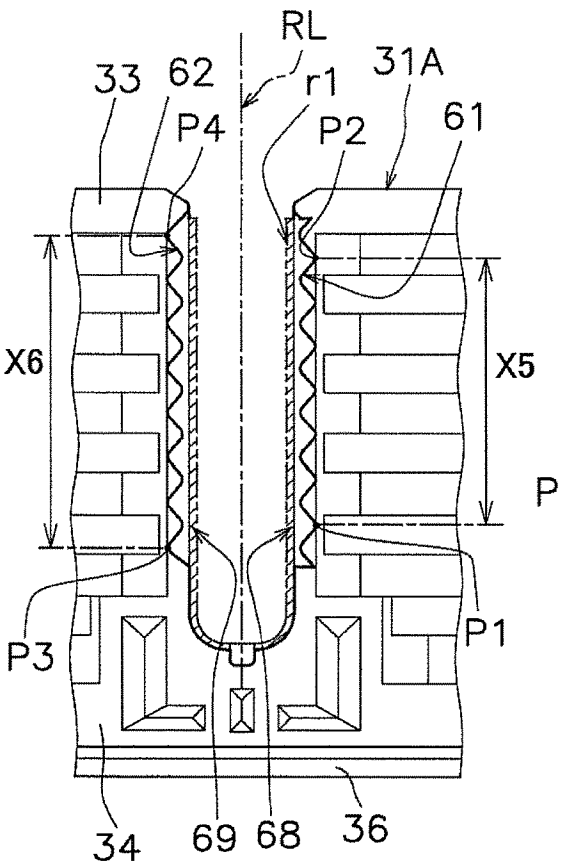
FIG. 10B is an expanded plan view of the heat transfer fin for explaining a brazing portion of the flat tube according to one or more embodiments.
Figure 10A:
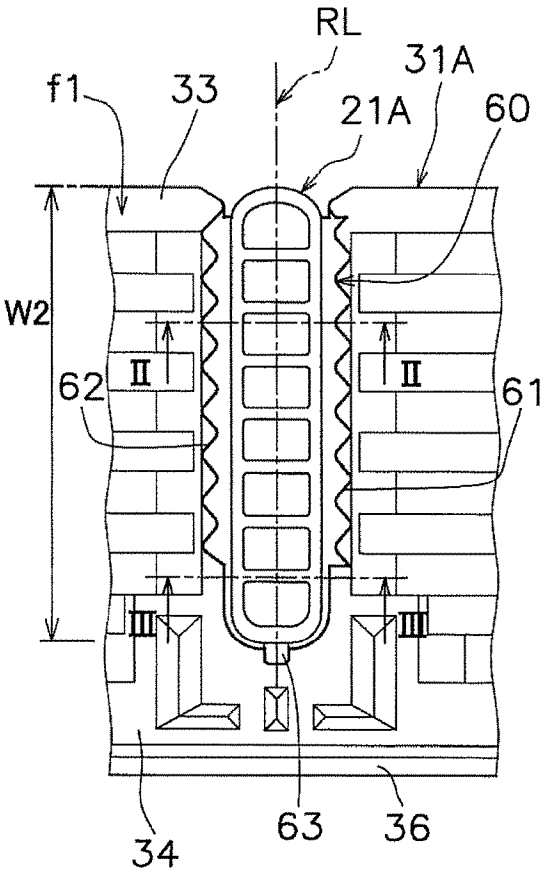
FIG. 10A is a partially expanded view of part of the heat transfer fin and a flat tube according to one or more embodiments.

The heat exchanger according to the one or more embodiment has the same configuration as the heat exchanger 91 according to the previously-described embodiments illustrated in FIG. 1 apart from details of a heat transfer fin 31A according to one or more embodiments illustrated in FIG. 10A. The heat exchanger 91 according to one or more embodiments described below also includes the first heat exchange portion 96 and the second heat exchange portion 97. Further, in the below embodiments, the first heat exchange portion 96 and the second heat exchange portion 97 each include a plurality of flat tubes 21A (see FIG. 10A) arranged in a row and a plurality of heat transfer fins 31A that intersect with the plurality of flat tubes 21A. The positional relationship between the plurality of flat tubes 21A and the plurality of heat transfer fins 31A and the configuration of the flat tube 21A according to below embodiments are substantially the same as the positional relationship between the plurality of flat tubes 21 and the plurality of heat transfer fins 31 and the configuration of the flat tube 21 according to the previously-described embodiments, and hence a description thereof is omitted.

(5-1) Configuration of Heat Transfer Fin 31A

FIGS. 10A, 10B and 10C illustrate a part of the heat transfer fin 31A in an enlarged manner according to one or more embodiments. FIG. 10A illustrates the heat transfer fin 31A in a state in which the flat tube 21A is inserted into the notch 35 and FIG. 10C illustrates the heat transfer fin 31A in a state in which the flat tube 21A is not inserted into the notch 35. FIG. 10B is an illustration for explaining a brazing portion of the flat tube 21A and the heat transfer fin 31.

Even in the heat transfer fin 31A, the notch 35 that receives the flat tube 21A is formed in the windward main portion 33 and the leeward communication portion 34 is located on a side opposite to the open end 35*a* of the notch 35. In this way, the basic configuration of the heat transfer fin 31A is the same as the heat transfer fin 31. The heat transfer fin 31A also includes the guide rib 36 and the collar portions 60 formed on the one main surface f1. A portion at which the flat tube 21A makes contact with the collar portion 60 is the portion indicated by hatching in FIG. 10B. The portion at which the flat tube 21A makes contact with the collar portion 60 is brazed. As indicated by the hatching in FIG. 10B, the shape of the notch 35 in plan view only needs to substantially match the external shape of the flat tube 21A in order to make the flat tube 21A contact with the collar portion 60 in a U-shape when viewed in plan.

(6) CONFIGURATION OF COLLAR PORTION 60

Each of the plurality of heat transfer fins 31A includes, in the collar portion 60, the three types of standing portions 61, 62, 63 provided on a peripheral portion of each notch 35 for forming gaps between adjacent heat transfer fins 31A. In this embodiment, the collar portion 60 includes seven wave-shaped standing portions 61, eight wave-shaped standing portions 62 and one wave-shaped standing portion 63. The standing portions 61 on either end of the long side 68 do not form a sufficient wave-shape and hence are not counted as one standing portion 61. Therefore, the number of standing portions 61, 62, 63 included in the collar portion 60 is 16 in total. In this way, at least three standing portions 61, 62, 63 are arranged so as not to face each other across the reference line RL that extends in the width direction through the perpendicular center portion of the flat tube 21. In this embodiment, 12 standing portions 61, 62, 63 are arranged so as not to face each other. In addition, in each of the plurality of heat transfer fins 31A, a plurality of the wave-shaped standing portions 61 are arranged on the long side 68 of the notch 35 and a plurality of the wave-shaped standing portions 62 are arranged on the long side 69 of the notch 35. The two long sides 68, 69 of the notch 35 face each other across the reference line RL. Similar to the previously-descried embodiments, the plurality of standing portions 61 and the plurality of the standing portions 62 are alternately arranged along the reference line RL. The long sides 68, 69 are linear portions along flat surfaces formed in the flat tube 21A. The standing portions 61, 62 on the two long sides 68, 69 in the notch 35 are formed into the wave shapes such that the standing portions 61, 62 can be fitted into each other when pushed down into the notch 35. This feature is also the same as the previously-described embodiments.

As illustrated in FIG. 10B, a distance X5 between a wave crest P1 of a standing portion 61 on one end of the long side 68 and a wave crest P2 of a standing portion 61 on the other end of the long side 68 is set to be at least one third of a width W2 of the flat tube 21A. Similarly, a distance X6 between a wave crest P3 of a standing portion 62 on one end of the long side 69 and a wave crest P4 of a standing portion 62 on the other end of the long side 69 is set to be at least one third of the width W2 of the flat tube 21A.

Figure 11:
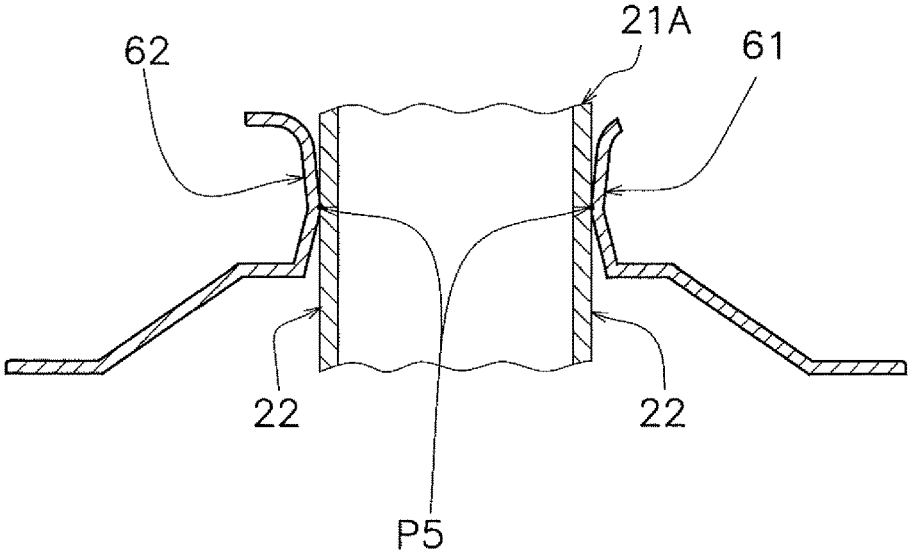
FIG. 11 is a cross-sectional view of the heat transfer fin and the flat tube taken along the line II-II in FIG. 10.
Figure 12:
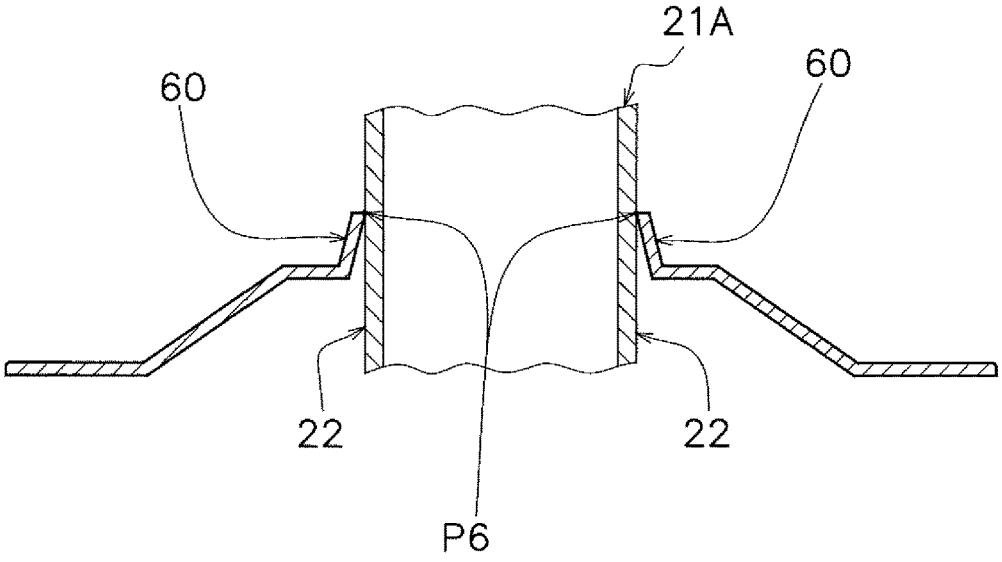
FIG. 12 is a cross-sectional view of the heat transfer fin and the flat tube taken along the line III-III in FIG. 10.

The flat tube 21A is pushed into the notch 35 until the flat tube 21A abuts against the standing portion 63 and comes into contact with the heat transfer fin 31A across the entire U-shaped region part r1 indicated by the hatching in FIG. 10B. FIGS. 11 and 12 show a cross section taken along the line II-II and a cross section taken along the line III-III of the collar portion 60 illustrated in FIG. 10A. The standing portions 61, 62 makes contact with a flat surface 22 of the flat tube 21A at a contact portion P5 illustrated in FIG. 11. In addition, the collar portion 60 makes contact with the flat surface 22 of the flat tube 21A at portions other than the wave-shaped standing portions 61, 62 (contact portion P6).

Figure 13:
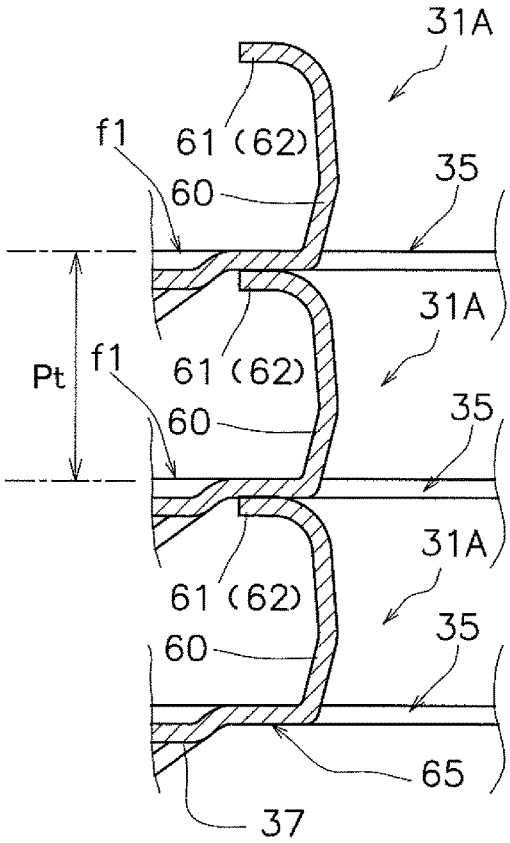
FIG. 13 is a partially expanded cross-sectional view for illustrating a state in which a plurality of heat transfer fins are stacked according to one or more embodiments.
Figure 14:
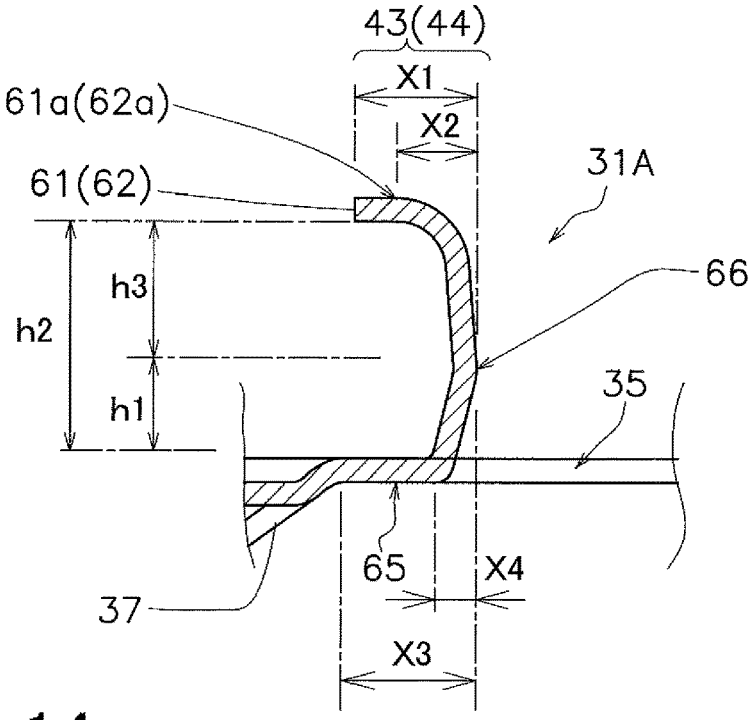
FIG. 14 is a partially expanded cross-sectional view for explaining the shape of the standing portion according to one or more embodiments.
Figure 15:
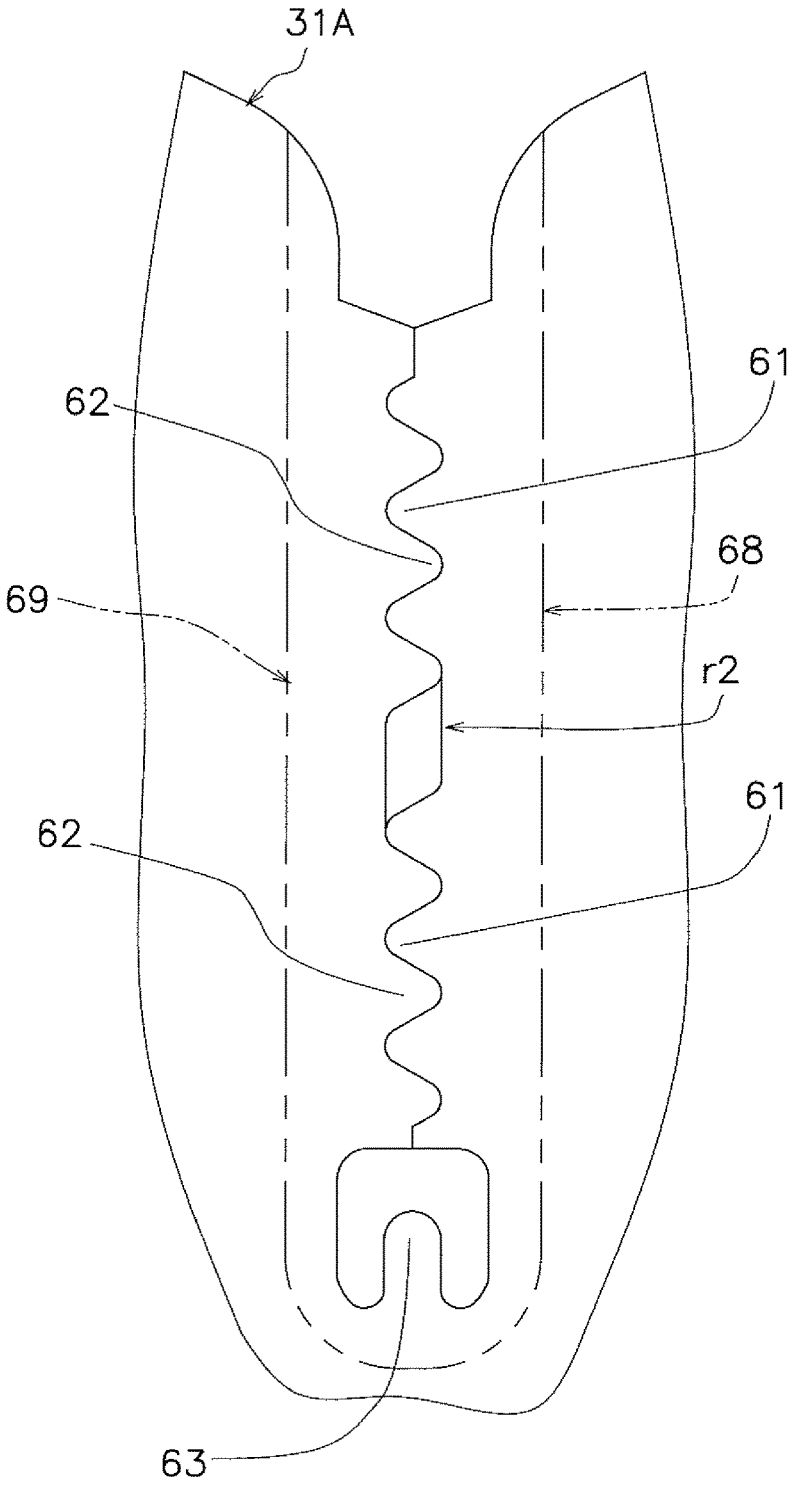
FIG. 15 is a partially expanded plan view of the material of the heat transfer fin for explaining another exemplary method for forming the standing portion according to one or more embodiments.
Figure 16:
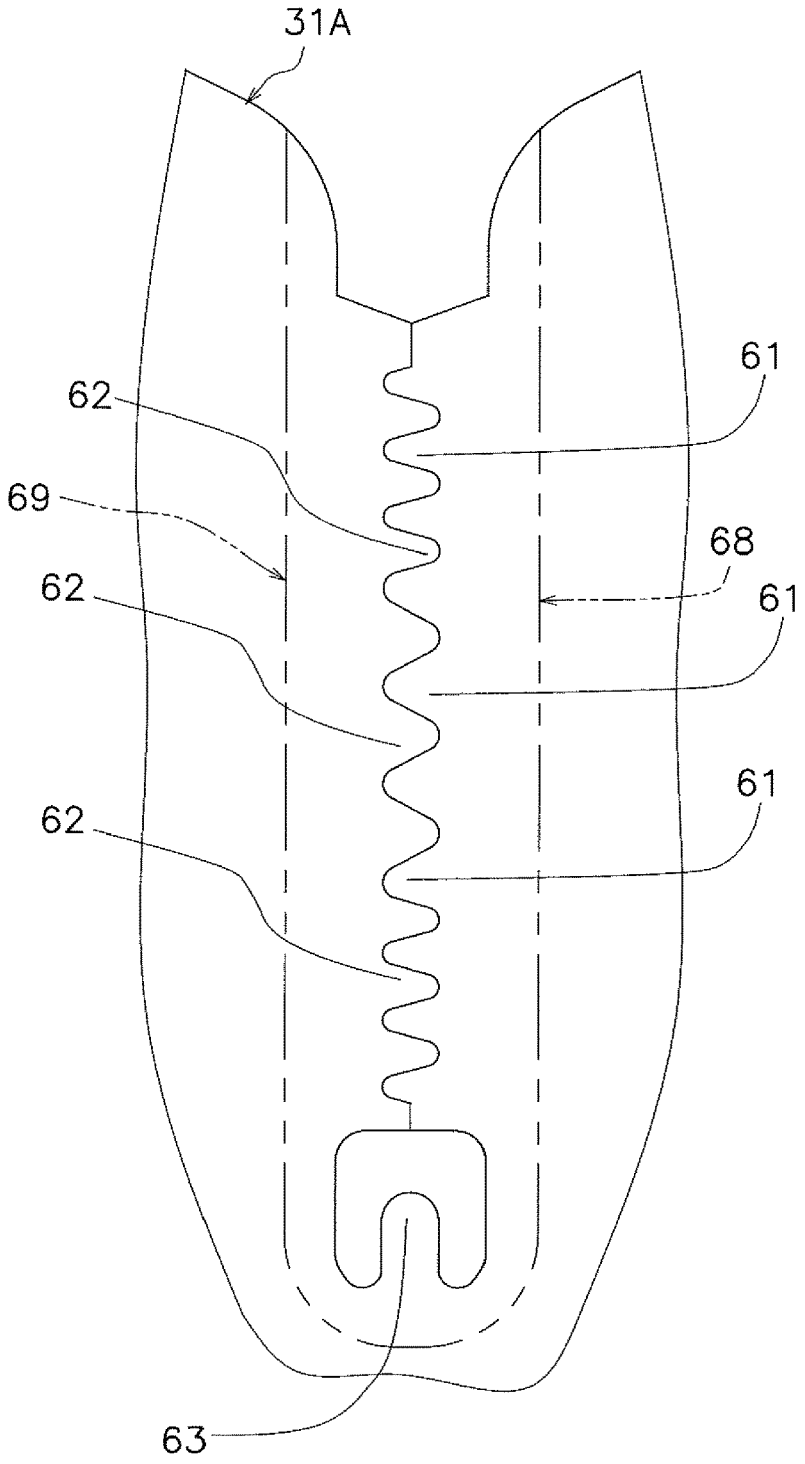
FIG. 16 is a partially expanded plan view of the material of the heat transfer fin for explaining yet another exemplary method for forming the standing portion according to one or more embodiments.
Figure 17:
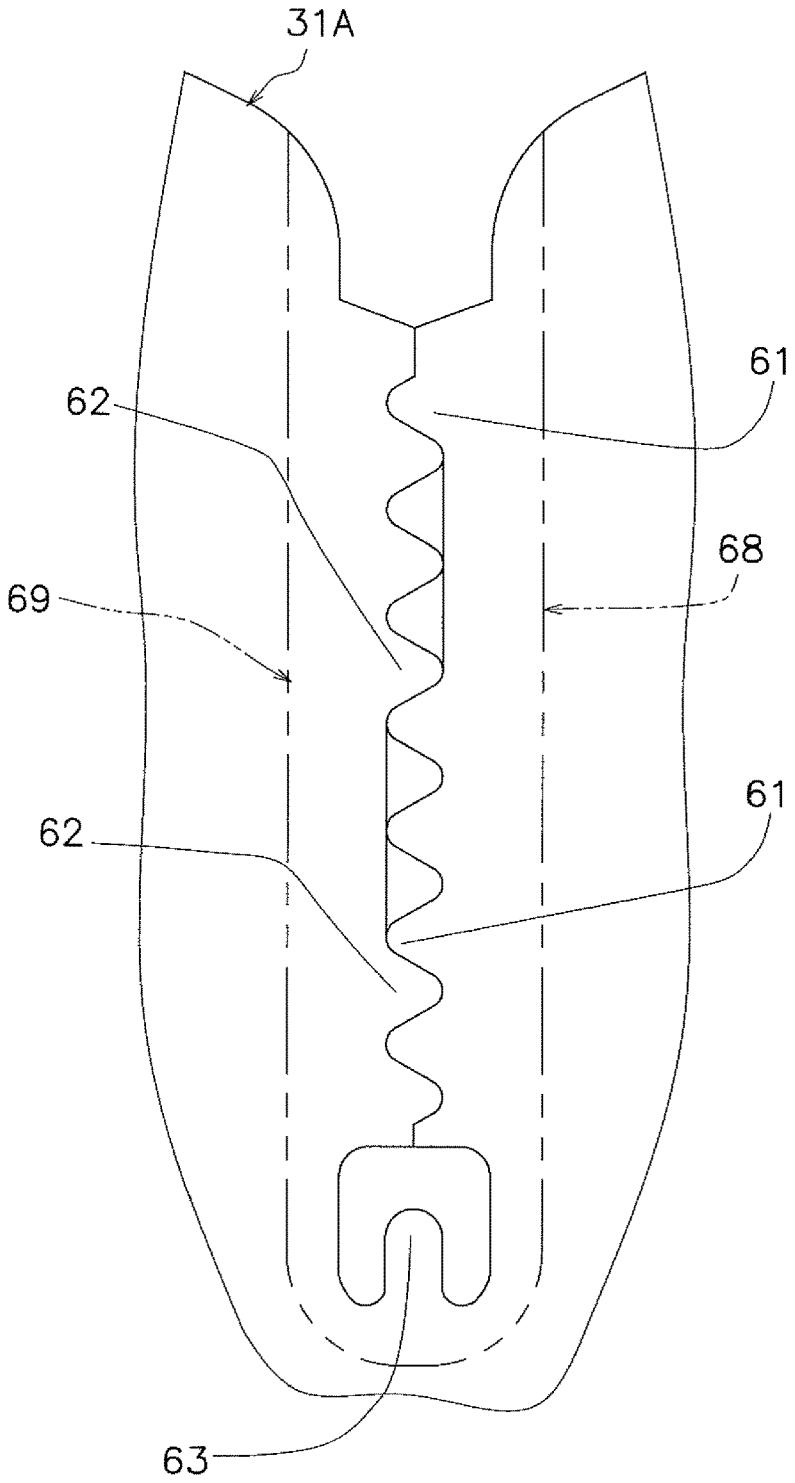
FIG. 17 is a partially expanded plan view of the material of the heat transfer fin for explaining further another exemplary method for forming the standing portion according to one or more embodiments.

FIG. 13 illustrates three of the plurality of stacked heat transfer fins 31A according to one or more embodiments. The gap between adjacent heat transfer fins 31A is formed by the collar portions 60. This gap is the fin pitch Pt between the plurality of heat transfer fins 31A. Similar to the heat transfer fins 31 according to the previously-described embodiments, the plurality of heat transfer fins 31A also include the bases 65 and the raised-lance elements 37. As illustrated in FIG. 14, the distance X1 from the edge 66 of the notch 35 to the end portions of the standing portions 61, 62 is set smaller than the distance X3 from the edge 66 of the notch 35 to the raised-lance element 37 so that the bases 65 and the standing portions 61, 62 easily abut against each other.

In addition, as illustrated in FIG. 14, each heat transfer fin 31A according to one or more embodiments has a reflare portion 43 in which the standing portion 61 is bent into an curved shape on a side opposite to the notch 35 and a reflare portion 44 in which the standing portion 62 is bent into an curved shape on a side opposite to the notch 35. The reflare portions 43, 44 according to one or more embodiments illustrated in FIG. 14 differ from the reflare portions 41, 42 according to the previously-described embodiments illustrated in FIG. 9 in that the reflare portions 43, 44 extend completely straight in the longitudinal direction of the main portion 33. Compared to a case where the reflare portions 41, 42 extend diagonally such that tips thereof approach the main portion 33, air resistance can be reduced in a case where the reflare portions 43, 44 extend completely straight.

The crest portions 61*a*, 62*a* of the reflare portions 43, 44 where the standing height of the standing portions 61, 62 is at a maximum are located outward than the edge 66 of the notch 35 by the predetermined distance X2. In one or more embodiments, the crest portions 61*a*, 62*a* of the reflare portions 43, 44 are flat and the predetermined distance X2 is defined as the distance closest to the edge 66 of the flat crest portions 61*a*, 62*a*. The distance X2 is set such that the flat base 65 is larger than the distance X4 from the edge 66 of the notch 35. In one or more embodiments, in consideration of evenly maintaining the fin pitch Pt using the height of the standing portions 61, 62, the distance X2 is set at least 0.2 mm larger than the distance X4 (X2−X4≥0.2 mm).

(7) MODIFICATION EXAMPLES (7-1) Modification Example 2A

In the collar portion 60 according to some of the above-described embodiments, the standing portion 63 does not need to be arranged at the deepest portion of the notch 35.

(7-2) Modification Example 2B

In some of the above-described embodiments, the standing portions 61, 62 formed into the wave-shape depict a wavy line that looks like a sine wave, but the wave shape formed by the standing portions 61, 62 does not need to be a wavy line and also includes, for example, a shape in which a triangle shape or a square shape repeats.

In addition, one or more embodiments, the plurality of wave-shaped standing portions 61, 62 are continuous on each long side 68, 69. However, the plurality of wave-shaped standing portions 61, 62 do not need to be continuous. For example, according to one or more embodiments illustrated in FIG. 15, there may be provided a portion r2 at which the wave shape formed by the standing portions 61, 62 stops partway.

In addition, in one or more embodiments, the length of the wave formed by the standing portions 61, 62 repeating on each long side 68, 69 is constant. However, according to one or more embodiments illustrated in FIG. 16, for example, the length of the wave shape formed by the plurality of standing portions 61, 62 repeating may not be constant.

In addition, in one or more embodiments, there is described a case where the standing portions 61, 62 repeatedly alternate one by one on each long side 68, 69 to form the wave shape, but the standing portions 61, 62 are not limited to repeating in this way. For example, according to one or more embodiments illustrated in FIG. 17, there may be adopted a configuration in which three standing portions 61 are arranged between two standing portions 62.

(7-3) Modification Example 2C

In some of the above-described embodiments, the heat transfer fin 31A communicates on the leeward side (see FIG. 1), but the heat transfer fin may communicate on the windward side.

(7-4) Modification Example 2D

The heat exchanger according to one or more embodiments of the present invention can be applied to an indoor unit of an air conditioner, an outdoor unit of an air conditioner, or a heat exchanger for a vehicle.

(8) FEATURES 8-1

The heat exchanger 91 according to the one or more embodiments achieves the actions and effects described in sections (4-1) to (4-8).

8-2

In the above-described heat exchanger 91, in the plurality of heat transfer fins 31, 31A, the plurality of standing portions 61, 62 on each long side 68, 69 forms the wave shape. Because the standing portions 61, 62 form the wave shape, the crest portions of the wave-shaped standing portions 61 or standing portions 62 on one of the long side 68 or the long side 69 are made to correspond to trough portions of the wave-shaped standing portions 61 or standing portions 62 on the other of the long side 69 or the long side 68. Therefore, the plurality of standing portions 61, 62 on each long side 68, 69 are more easily formed high. For example, the crest portion P11 of the standing portion 61 illustrated in FIG. 10C corresponds to the trough portion B1 of the standing portion 62. In addition, the crest portion P12 of the standing portion 62 corresponds to the trough portion B2 of the standing portion 61. Because the plurality of standing portions 61, 62 can be more easily made taller, it is easier to adopt a thin flat tube 21, 21A and the heat exchanger can be more widely applied.

A case where the wave-shaped standing portions 61, 62 are cut and separated at the cutting line 70 is described as a case of forming the wave-shaped standing portions 61, 62, but the method for separating the standing portions 61, 62 is not limited to using the cutting line 70 and may involve, for example, forming a thin groove between the standing portions 61, 62 to separate the standing portions 61, 62. Even in this case, an effect of more easily forming the plurality of standing portions 61, 62 taller on each long side 68, 69 is achieved.

Note that, in a case where the standing portions do not have crest portions, a portion at which the distance is smallest when, for example, the portion at the crest portion of the standing portion is parallel to the reference line RL shall be measured.

8-3

In the heat exchanger 91 according to one or more embodiments, in each of the plurality of heat transfer fins 31A, the distance X5, X6 between the wave crest P1, P3 of the wave-shaped standing portion 61, 62 on one end of the standing portions 61, 62 on the two long sides 68, 69 and a wave crest P2, P4 of the standing portion 61, 62 on the other end of the standing portions 61, 62 is at least one third of the width of the flat tube 21A. In other words, it is easier to extend the distance along which the long sides 68, 69 abut against the adjacent heat transfer fins 31A to at least one third of the width of the flat tube 21A. In addition, the heat transfer fins 31A are more easily stabilized when the plurality of heat transfer fins 31A are stacked and it is easier to obtain a heat exchanger 91 having even intervals between the heat transfer fins 31A. In addition, even with the heat exchanger 91 according to some of the above-described embodiments, in the plurality of heat transfer fins 31, the distance X5, X6 between the wave crest of a standing portion 61, 62 on one end of the standing portions 61, 62 on the two long sides 68, 69 and a wave crest of a standing portion 61, 62 on the other end of the standing portions 61, 62 is at least one third of the width of the flat tube 21A and produces the same effect.

Although the disclosure has been described with respect to a limited number of embodiments, those skilled in the art, having benefit of this disclosure, will appreciate that various other embodiments may be devised without departing from the scope of the present invention. Accordingly, the scope of the present invention should be limited only by the attached claims.

REFERENCE SIGNS LIST

21, 21A Flat tube
31, 31A Heat transfer fin
35 Notch
37 Raised-lance element (example of Protruding portion)
61, 62, 63 Standing portion
65 Base (example of Flat portion)
67 Deepest portion
68,69 Long side
91 Heat exchanger
96 First heat exchange portion
97 Second heat exchange portion

CITATION LIST

Patent Literature

[Patent Literature 1] Japanese Patent Unexamined Publication 2012-163318

The invention claimed is:

1. A heat exchanger comprising:

a plurality of flat tubes that each have a cross-sectional shape perpendicular to a direction of refrigerant flow inside the tubes and a width direction that extends in a direction of air flow between the tubes; and a plurality of heat transfer fins each having a plurality of notches, each of the notches having a tube of the plurality of tubes disposed therein, wherein each of the notches has two long sides that extend along the width direction and face each other across a respective reference line that extends in the width direction through a center of the tube disposed in the respective notch, wherein three separate standing portions are disposed on a periphery of each of the notches, the plurality of fins being arranged such that adjacent fins of said plurality are spaced apart by the standing portions, wherein a first standing portion of the three standing portions is disposed on one of the long sides and comprises a plurality of first stands, a second standing portion of the three standing portions is disposed on the other long side and comprises a plurality of second stands, and a third standing portion of the three standing portions is disposed on the periphery at a position such that the three standing portions do not face each other across the respective reference line, wherein the plurality of first stands form a first wave-shape, the first standing portion having a first end wave crest at a first end of the first wave-shape and a second end wave crest at a second end of the first wave-shape, wherein the plurality of second stands form a second wave-shape, the second standing portion having a first end wave crest at a first end of the second wave-shape and a second end wave crest at a second end of the second wave-shape, and wherein a distance from the first end wave crest to the second end wave crest of at least one of the first and second standing portions is at least one third of a width of the plurality of flat tubes.

2. An air conditioner comprising the heat exchanger according to claim 1.

* * * * *